United States Patent [19]

Brendel et al.

[11] 4,224,085

[45] Sep. 23, 1980

[54] WIRE FORMING PROCESS

[75] Inventors: Thomas A. Brendel, Maybrook, N.Y.; Pierre P. Turillon, Ramsey, N.J.

[73] Assignee: The International Nickel Co., Inc., New York, N.Y.

[21] Appl. No.: 926,754

[22] Filed: Jul. 21, 1978

[51] Int. Cl.[2] ..... B22F 3/24; C21D 1/74; C21D 9/08; C21D 1/80

[52] U.S. Cl. ..... 148/11.5 P; 148/11.5 Q; 29/420; 75/208 CS; 148/133; 428/660; 428/674

[58] Field of Search ..... 29/420, 420.5; 75/208 R, 208 CS; 148/133, 11.5 F, 11.5 R, 11.5 C, 11.5 P.11.5 Q; 428/662, 660, 674

[56] References Cited

U.S. PATENT DOCUMENTS

| | | | |
|---|---|---|---|
| 936,403 | 10/1909 | von Bolton | 264/104 |
| 2,750,658 | 6/1956 | Went et al. | 29/191.2 |
| 2,756,492 | 7/1956 | Pettibone | 29/420.5 |
| 2,804,409 | 8/1957 | Kessler et al. | 148/11.5 F |
| 2,888,740 | 6/1959 | Danis | 29/191.2 |
| 3,124,455 | 3/1964 | Buehler et al. | 264/111 |
| 3,285,786 | 11/1966 | Katz | 264/104 |
| 3,394,036 | 7/1968 | Parris | 148/133 |
| 3,474,516 | 8/1969 | Finlay et al. | 75/226 |
| 3,525,150 | 8/1970 | Deiness | 29/599 |
| 3,738,827 | 6/1973 | Pryor et al. | 75/76 |
| 3,767,888 | 10/1973 | Sullivan | 219/146 |
| 3,778,587 | 12/1973 | Kubli et al. | 219/146 |
| 3,778,588 | 12/1973 | Bishel | 219/146 |
| 3,826,124 | 7/1974 | Baksay | 148/11.5 F |
| 3,892,030 | 7/1975 | DePierre et al. | 29/420 |
| 3,969,155 | 7/1976 | McKeighen | 148/11.5 F |
| 4,042,753 | 8/1977 | Smith | 428/651 |

FOREIGN PATENT DOCUMENTS

| | | | |
|---|---|---|---|
| 1389595 | 4/1975 | United Kingdom | 148/11.5 F |

OTHER PUBLICATIONS

Niobond & Tibond, Marston Excelsior Ltd., Wobaston Rd, Fordhouses, Wolverhampton, WV 106Q5, England, 11/30/1977, 4 pp.

*Primary Examiner*—Francis S. Husar
*Assistant Examiner*—V. K. Rising
*Attorney, Agent, or Firm*—F. J. Mulligan

[57] ABSTRACT

A process of producing copper-cored titanium wire of less than 16 gauge comprising cold drawing, in a multiplicity of passes, a titanium tube filled with copper powder.

3 Claims, 2 Drawing Figures

WIRE FORMING PROCESS

The present invention relates to composite metal products and more particularly to corrosion-resistant electrically conductive composite wire of small cross-sectional dimension.

BACKGROUND OF THE INVENTION

There are many uses for corrosion-resistant electrical conductors having relatively low resistance losses, such conductors, for instance, can be used in various electrochemical apparatus of different shapes and sizes. In view of known desirable corrosion-resistant characteristics of titanium it has been proposed to protect copper conductors with titanium and it is understood that titanium-clad copper products have been made commercially available in rod and wire forms, e.g., rods such as 12.7 mm or 6.4 mm in diameter and wire no smaller than 2 mm.

For certain purposes, it is desired to provide special corrosion-resistant electrical conductor materials suitable for apparatus where corrosion-resistant conductors of small cross-sectional area, good ductility and strength are needed for making complex intricate articles of wire such as mesh battery grids and medical implants. For these and other needs a special product comprising a fine wire having a protective cladding of titanium enclosing an electrically conductive copper core is now provided. As far as is known titanium-clad copper wire smaller than 14 British Standard Gauge (BSG) (2.032 mm) is not presently available on a commercial scale.

DISCOVERY OBJECTS AND DRAWING

It has now been discovered that titanium-clad copper-cored wire having desirable corrosion-resistance and electrical conductivity and other beneficial characteristics can be provided by means of a special thermomechanical powder metallurgical process.

An object of the present invention is to provide a titanium-copper composite fine wire product.

Another object of the invention is a process for preparing titanium-copper composite fine wire.

Figure 1:
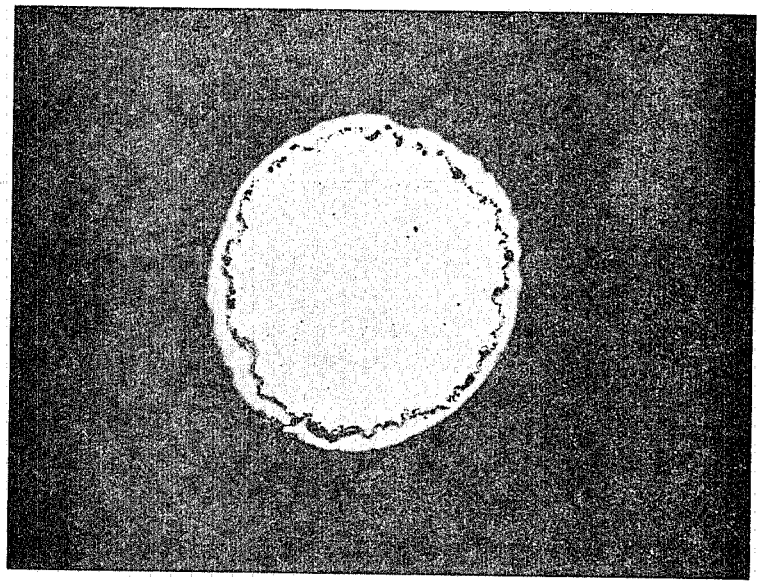
Figure 2:
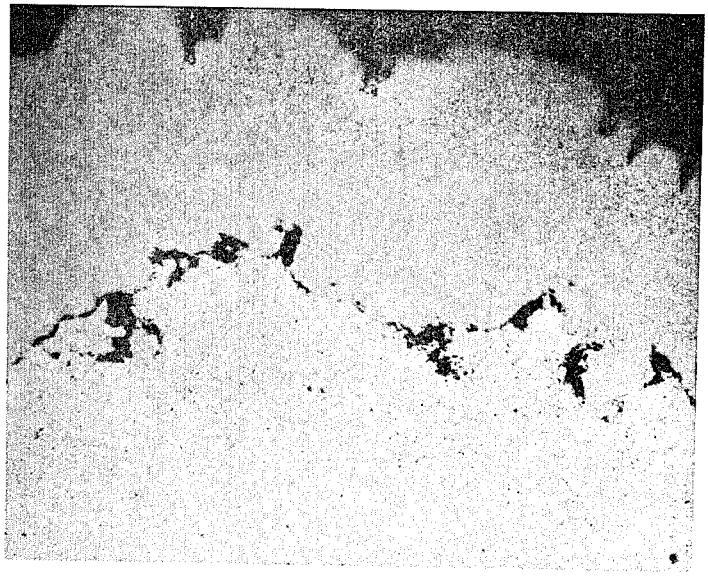

Other objects of the invention will become apparent from the following description and accompanying drawing wherein:

FIG. 1 is a photomicrograph, at 100X, of a cross-sectional specimen of a copper-cored titanium-clad fine wire made by the process of the invention; and FIG. 2 is a 500X magnification photomicrograph of a portion of the specimen shown in FIG. 1.

DESCRIPTION OF THE INVENTION

The present invention contemplates a fine wire (i.e., 16 BSG or finer) made of titanium-clad copper and a process wherein a tube of titanium metal is filled with copper powder to a packed powder density of about 50% to 80% theoretical the ends of the tube are closed tightly against the powder, and the assembly is swaged, annealed and cold drawn, in multiple steps, down to the required fine wire size, whereby the powder particles are integrated together in the tube to become a continuous solid copper core and the titanium is formed to a continuous sheath of cladding surrounding the core. The titanium sheath is in metal-to-metal contact with the copper core but is not necessarily metallurgically bonded thereto.

For most practical purposes, the fine composite wire of the present invention is of circular cross-section of 17 to 23 BSG (0.254 to 1.42 mm OD) with a sheath thickness of titanium (hereinafter defined alloys) of about 0.025 to 0.125 mm included within the OD dimension.

For the assembly at the beginning of the process, the titanium tube is wrought titanium or a cold-workable titanium alloy (for purposes of this specification and claims designated "titanium metal") and the copper powder is of small particle size not exceeding 20 mesh (U.S. Sieve Series, 1940). The titanium metal of the tube can be commercially pure titanium or can be a cold-workable titanium alloy containing 80% or more titanium that is characterized by reduction of area of about 20%, or more in room temperature tensile testing. Alloying ingredients in the titanium metal may include up to 10% each aluminum, vanadium, tin, molybdenum, zirconium, chromium and iron, provided of course that the proportions are compatible with satisfactory workability and the total of the alloying ingredients does not exceed 20%. The copper powder contains at least 90% copper and can include up to 10% nickel, up to 5% chromium, up to 2% silicon, up to 2% manganese, up to 0.5% phosphorus, up to 0.5% boron, up to 0.5% zirconium, according to the intended use of the wire. Amounts of elements such as lead, bismuth or tellurium which would be detrimental to workability or ductility of the composite should be avoided or restricted to low levels, e.g., about 0.1%, in the copper powder. For good conductivity results, the copper powder should be made from electrical grades of copper such as ETP (electrolytic tough pitch) or OFHC (oxygen free high conductivity), which usually have a copper content of at least 99.8% and are characterized by an electrical resistivity of 2 microhmcentimeters or less. Silver powder can be substituted for all or part of electrical grade copper powder. Copper, copper alloys and silver are all designated, for purposes of this specification and claims, "copper".

In carrying the invention into practice to make copper-cored titanium-clad fine wire, it is advantageous to provide that:

(a) the titanium tube size be about 13 to 50 mm outside diameter, 0.25 to 2.5 mm wall thickness, and have a length at least ten times outside diameter (10×O.D.);

(b) the copper powder size be substantially all thru 200 mesh with about half thru 325 mesh, e.g., 100% of the powder finer than 200 mesh with about 50% being larger than 325 mesh; and (c) the tube be filled to have a copper powder density, when filled and sealed, of 50% to 80% of theoretical (copper density of 8.95).

For most instances it is desirable to provide that the titanium tubing initially have a diameter size for drawing through a die series wherein the ratio of initial die size (i.e., diameter or other maximum cross-section distance) to final wire die size is in the range of 10 to 500, preferably about 100.

Heat treatment for annealing can be at about 540° C. to about 870° C. for 0.1 to 4 hours or longer. Advantageously, annealing is controlled to provide the metallurgical condition that is obtained by heating one hour at 815° C.

For purposes of giving those skilled in the art a better understanding of the invention and advantages thereof, the following example is given:

EXAMPLE

A 25.4 cm length of commercial-grade titanium tubing was filled with copper powder poured into the tube. The ends were closed with 3.8 cm long plugs inserted at each end and sealed by swaging the plugged ends. Tubing size was 12.7 mm outside diameter, 0.85 mm wall thickness. The commercial-grade titanium composition contained only trace impurities of oxygen and nitrogen. The copper powder was a commercial (Greenback Co.) product characterized by at least 99.25% copper content and particle size finer than 200 mesh wire 82% thru 325 mesh. Density of the copper powder when sealed in the tube was estimated as about two-thirds the density of solid copper. After swaging, the filled and sealed tube was heated one hour at 815° C. for annealing. The annealed tube was drawn down from the 12.7 mm diameter to 5.8 mm diameter, and, in succession, annealed again at 815° C., drawn down to 1.73 mm diameter, treated with a third 1-hour anneal at 815° C., and then drawn down to the final wire size of 1.02 mm outside diameter. Thus, drawing between anneals was done in a succession of passes thru a die size series of about 10% to 18% reduction of area per pass. Annealing and cooling atmospheres were air without forced circulation. Drawing was done "cold" (at or near room temperature).

The resulting wire of the example had a continuous crack-free exterior surface of titanium-cladding. Cross-sectional specimens were seen, by metallographic examination, e.g., as illustrated by FIGS. 1 and 2, to have a solid copper core contacting the interior of the titanium-cladding, which was about 0.04 mm thick. Density of the copper in the core was 98% or greater. Electrical resistance measurements gave a total resistance of 0.1084 ohm between contacts which were spaced apart on the titanium by a 2.13 meter wire-length distance and confirmed that the copper core served satisfactorily as the major conductor for electrical current flowing between the contacts on the titanium. Results of room temperature tensile testing of the 1.02 mm diameter wire in the as-drawn condition were: 47.7 H bar ultimate tensile strength; 48.3 H bar yield strength (0.2% offset) and 0.3% elongation in 25.4 cm gage length. Bend testing showed satisfactory ductility for bending completely around 0.32 centimeter diameter rod.

Although the process is exemplified with wire of cricular cross-section, the process is generally applicable to preparing various cross-sectional wire configurations, e.g., triangular or rectangular.

The present invention is particularly applicable in the production of composite wire for corrosion resistant electrical conductors or electrodes, e.g., electric leads through corrosive media including molten glasses and silicates, screen grid electrodes for electrochemical apparatus, or miniature electrodes for implants, and also for conductors used in marine environment, such as cathodic protection electrodes and wire for corrosive industrial atmospheres in gauges which are suitable for weaving and other types of forming into small dimensioned components.

We claim:

1. A process for producing copper-cored titanium wire of maximum 16 gauge comprising filling a titanium metal tube with powdered copper to provide a packed powder density of about 50% to 80% theoretical, sealing said filled tube, and carrying out a multiplicity of operations comprising annealing the filled tube and cold drawing the annealed structure through a die to provide a wire of 16 gauge or finer said operations being characterized by a ratio of initial die size to final wire die size is in the range of 10 to 500.

2. A process as in claim 1, wherein annealing in each operation is that equivalent to that annealing obtained by heating for 1 hour at 815° C.

3. A process as in claim 1, wherein the titanium and copper are essentially pure metals.

* * * * *